US008627957B2

(12) United States Patent
Ziemba et al.

(10) Patent No.: US 8,627,957 B2
(45) Date of Patent: Jan. 14, 2014

(54) SEALABLE SECONDARY PACKAGING FOR PHARMACEUTICAL PRODUCT BLISTER PACK

(71) Applicant: Mallinckrodt LLC, Hazelwood, MO (US)

(72) Inventors: Robert J. Ziemba, Cincinnati, OH (US); Vernon D. Ortenzi, Burlington, KY (US)

(73) Assignee: Mallinckrodt LLC, Hazelwood, MO (US)

( * ) Notice: Subject to any disclaimer, the term of this patent is extended or adjusted under 35 U.S.C. 154(b) by 0 days.

(21) Appl. No.: 13/691,766

(22) Filed: Dec. 1, 2012

(65) Prior Publication Data

US 2013/0087475 A1 Apr. 11, 2013

Related U.S. Application Data

(62) Division of application No. 13/103,247, filed on May 9, 2011, now Pat. No. 8,342,331.

(60) Provisional application No. 61/333,174, filed on May 10, 2010.

(51) Int. Cl.
*B65D 83/04* (2006.01)
*B65D 5/66* (2006.01)

(52) U.S. Cl.
USPC ..... 206/532; 206/539; 229/147

(58) Field of Classification Search
USPC ..... 206/531, 532, 538, 539; 229/141–144, 229/147, 148, 245–247, 124, 125
See application file for complete search history.

(56) References Cited

U.S. PATENT DOCUMENTS

| | | | | |
|---|---|---|---|---|
| 259,076 | A * | 6/1882 | Bainbridge | 229/147 |
| 2,422,605 | A * | 6/1947 | Wells | 206/532 |
| 2,998,180 | A | 8/1961 | Dehoney | |
| 3,404,829 | A * | 10/1968 | Stone | 229/148 |
| 3,799,332 | A * | 3/1974 | Jeronimus | 229/125 |
| 4,254,871 | A | 3/1981 | Poore | |
| 4,750,609 | A * | 6/1988 | Felis | 229/141 |
| 6,705,467 | B1 | 3/2004 | Kancsar et al. | |
| 6,793,077 | B1 | 9/2004 | Kancsar et al. | |
| 6,951,282 | B2 | 10/2005 | Jones | |
| 6,964,338 | B2 | 11/2005 | Kancsar et al. | |
| 6,974,031 | B2 | 12/2005 | Kancsar et al. | |

(Continued)

FOREIGN PATENT DOCUMENTS

WO 2005068316 7/2005

*Primary Examiner* — Bryon Gehman
(74) *Attorney, Agent, or Firm* — Marsh Fischmann & Breyfogle LLP

(57) ABSTRACT

A pharmaceutical product supply is disclosed in the form of a container, a pharmaceutical product receiver, pharmaceutical product, an adhesive, and at least one release liner. The pharmaceutical product receiver includes a plurality of receptacles for pharmaceutical product. The container is initially disposed in a first configuration where all of the pharmaceutical product receiver receptacles may be accessible. The container is thereafter disposable in a second configuration where no covering for any of the pharmaceutical product receiver receptacles is accessible through any openable access incorporated by the container. One or more release liners may be moved to expose adhesive for disposing and retaining the container in its second configuration. The noted second configuration of the container facilitates disposal of the pharmaceutical product supply (e.g., now being in a form that should reduce the potential for gaining access to any remaining pharmaceutical product still enclosed within the pharmaceutical product receiver).

19 Claims, 8 Drawing Sheets

(56) References Cited

U.S. PATENT DOCUMENTS

| | | | | |
|---|---|---|---|---|
| 7,025,207 | B2 * | 4/2006 | Breu et al. | 206/531 |
| 7,641,050 | B2 | 1/2010 | Klatt et al. | |
| 7,735,650 | B2 | 6/2010 | Zumbiel | |
| 7,967,143 | B2 * | 6/2011 | Paliotta et al. | 206/531 |
| 2005/0173291 | A1 * | 8/2005 | Specker et al. | 206/538 |

* cited by examiner

SEALABLE SECONDARY PACKAGING FOR PHARMACEUTICAL PRODUCT BLISTER PACK

CROSS-REFERENCE TO RELATED APPLICATIONS

This patent application is a divisional patent application of U.S. patent application Ser. No. 13/103,247, filed on May 9, 2011(now U.S. Pat. No. 8,342,331, issued on Jan. 1, 2013), which is a non-provisional application of U.S. Provisional Patent Application Ser. No. 61/333,174, entitled "SEALABLE SECONDARY PACKAGING FOR PHARMACEUTICAL PRODUCT BLISTER PACK," and filed on May 10, 2010. The entire disclosure of each of the above-noted patent applications is incorporated by reference herein, and priority is claimed to each of the above-noted patent applications.

FIELD OF THE INVENTION

The present invention generally relates to the field of packaging for pharmaceutical products such as pills, capsules, patches, and the like and, more particularly, to packaging configurations that facilitate the disposal of pharmaceutical products (e.g., to reduce the potential of illicit usage of unused pharmaceutical product).

BACKGROUND

Abuse, misuse, and overdose of pharmaceutical products (e.g., pain management drugs) are serious health concerns that affect many people on a daily basis all over the world. For instance, diversion and subsequent misuse or abuse may occur when a patient gets a prescription for a pharmaceutical product and does not use all of the pharmaceutical product for whatever reason (e.g., a doctor may prescribe a pharmaceutical product for a patient and advise the patient to take the pharmaceutical product on an "as needed" basis; a patient may be advised to use an entire prescribed amount of pharmaceutical product, but may unilaterally decide to discontinue use of the pharmaceutical product as one or more symptoms disappear). In any case, remaining pharmaceutical product may be ultimately acquired by an individual other than for whom the pharmaceutical product was originally prescribed (e.g., transferred by the original patient to another individual, such as family member or friend; stolen). While unused pharmaceutical product may be disposed of in the trash, this may not be viewed by some as a secure method of disposal.

In the case of transdermal analgesic patches, a used patch may still retain a significant amount of active ingredient in the patch. A used patch can be very dangerous and can even lead to death for people who have not been prescribed the patch. While some patch manufacturers recommend flushing used patches down the toilet, this practice has raised concerns about drug product entering the water supply. In some states, "take back" programs have been instituted, allowing users to request shipping materials in order to ship used or unused pharmaceutical product (e.g., patches, pills, capsules) to a certified disposal company. These programs are costly and require several actions by the patient at multiple times.

SUMMARY

The present invention embodies a pharmaceutical product supply. This pharmaceutical product supply includes a container, a pharmaceutical product receiver, pharmaceutical product, an adhesive, and a release liner. More specifically, the pharmaceutical product receiver includes a plurality of pockets or receptacles. Each receptacle includes an opening, and at least one covering is disposed over the opening of at least one the receptacles. Pharmaceutical product is enclosed within at least one of these receptacles by its corresponding covering. The adhesive is provided on the container, on the pharmaceutical product receiver, or on each of the container and the pharmaceutical product receiver. The release liner is positioned over the adhesive. The container is initially disposed in a first configuration where the covering for at least one of the pharmaceutical product receiver receptacles is accessible. The container is thereafter disposable in a second configuration where the covering for none of the pharmaceutical product receiver receptacles is accessible through any openable access incorporated by the container. The release liner is moved to expose the adhesive for disposing and retaining the container in its second configuration (where none of the pharmaceutical product receiver receptacles are accessible through any openable access incorporated by the container).

A number of feature refinements and additional features are applicable to the present invention. These feature refinements and additional features may be used individually or in any combination. As such, each of the following features that will be discussed may be, but are not required to be, used with any other feature or combination of features of the present invention. Generally, the container may be of a configuration and the adhesive may be incorporated in a manner such that moving the release liner to expose the adhesive may accommodate securing (e.g., locking via cured adhesive) the pharmaceutical product receiver within the container, for instance to facilitate disposal of the pharmaceutical supply at a time when some of the pharmaceutical product may have been removed from the pharmaceutical product receiver, but prior to utilizing all of the pharmaceutical product originally provided with the pharmaceutical product receiver. That is, the noted second configuration of the container may be characterized as facilitating disposal of the pharmaceutical product supply (e.g., now being in a form that should reduce the potential for gaining access to any remaining pharmaceutical product enclosed within the pharmaceutical product receiver). At the time of disposal, typically one or more of the pharmaceutical product receiver receptacles will be empty (the pharmaceutical product having been previously removed therefrom), while at least one of the receptacles will still have pharmaceutical product enclosed therein.

The opening for each receptacle may be characterized as being disposed on a common side of the pharmaceutical product receiver. In the "as dispensed" configuration, the opening of each receptacle may be blocked by a corresponding covering (e.g., pharmaceutical product may be enclosed within each receptacle). At this time, the container may be in its first configuration. Although the container could also be disposed in its second configuration (where the covering for none of the receptacles is accessible through any openable access incorporated by the container) with the opening of each receptacle still being blocked by its corresponding covering, more typically pharmaceutical product will have been removed from at least one of the receptacles. As such, it will more typically be the case that the covering associated with at least one of the receptacles will also have been removed or otherwise ruptured, torn, ripped, pierced, or the like to allow removal of the pharmaceutical product for such a receptacle(s) at the time the container is disposed in its second configuration.

The container may be characterized as a "secondary packaging," while the pharmaceutical product receiver may be characterized as "primary packaging." The pharmaceutical product receiver may be in the form of a blister card or blister packaging. Scoring or perforations could be provided between each adjacent pair of receptacles of the blister card. As such, a single "blister pack" could be removed from the remainder of the blister card and for any appropriate reason.

The above-noted blister card may be in the form of a pre-formed tray or the like having a number of receptacles or pockets. Any appropriate number of receptacles may be incorporated by the blister card. The various receptacles may be disposed in any appropriate arrangement, for instance in the form of a matrix having a certain number of rows and a certain number of columns at the time the blister card is dispensed to a patient or other end user.

An appropriate covering may be positioned over each receptacle in the above-noted blister card tray to enclose the associated pharmaceutical product. Such a covering may be in the form of a film, a foil, paper, a sheet-like material, or the like. In any case, this covering may be secured to the tray in any appropriate manner to seal pharmaceutical product within each of the various receptacles (e.g., a single pharmaceutical product dose). In one embodiment, this covering is rupturable over each of the individual receptacles of the tray to gain access to the pharmaceutical product within the receptacle. Rupturing the covering that overlies one receptacle should not affect the covering over any of the other receptacles (e.g., pharmaceutical product in these other receptacles should remain enclosed within the tray by the covering). In another embodiment, the covering may be "peeled" away from at least part of the tray to expose pharmaceutical product in at least one receptacle. Although a single covering could be positioned over each of the various receptacles, individual coverings could be positioned over each individual receptacle.

The adhesive may be incorporated only on the container, or only on the pharmaceutical product receiver. The adhesive may also be incorporated by each of the container and the pharmaceutical product receiver. One release liner may be provided for the adhesive on the container, and another release liner may be provided for the adhesive on the pharmaceutical product receiver. Any appropriate adhesive may be used.

The container may be of a variety of different configurations to facilitate the disposal of unused pharmaceutical product still contained within the pharmaceutical product receiver. In one embodiment, the container is in the form of a tri-fold carton or a three-paneled structure (in one embodiment the container includes only three panels). Consider the case where the container includes first, second, and third panels, with the second panel being located between the first and third panels. One boundary region may exist at the intersection between the first and second panels (e.g., a "fold line" at the intersection between the first and second panels). Another boundary region may exist between the second and third panels (e.g., a "fold line" at the intersection between the second and third panels).

The pharmaceutical product receiver may be incorporated by the second panel of a three-paneled container in any appropriate manner (e.g., positioned or mounted on a first side of this second panel). Each of the first and third panels may be configured so as to not incorporate any openable access (e.g., no openable cover/lid/flap included in either of the first or third panels; no perforations or scoring included in either of the first or third panels for defining an openable cover/lid/flap; such that no covering for any receptacle of the pharmaceutical product receiver is accessible when the container is disposed in its second configuration). A first adhesive may be provided on all or a portion of a surface or side of the first panel that is disposable in interfacing relation with the pharmaceutical product receiver (e.g., the side of the receiver through which the receptacles may be accessed to retrieve pharmaceutical product—the side with one or more coverings). A first release liner may be provided for this first adhesive. A second adhesive may be provided on all or a portion of a surface or a side of the third panel that is disposable in interfacing relation with a second side of the second panel (opposite of the side that includes the pharmaceutical product receiver). A second release liner may be provided for the second adhesive. The first and second release liners may be removed from the corresponding adhesive, the first panel may be folded onto and may adhere to the pharmaceutical product receiver, and the third panel may be folded onto and may adhere to the opposite side of the second panel. In one embodiment, the first and third panels are pivoted in the same general direction (e.g., in an end view of the container, in a common clockwise or counterclockwise direction) to secure the pharmaceutical product receiver between the first and third panels. The pharmaceutical product supply may be in the form of a stack when folded and adhesively joined in the above-noted manner. This particular three-paneled configuration may itself be an independent aspect of the present invention.

The pharmaceutical product receiver may itself be the second panel of a three-paneled container. Each of the first and third panels may be configured so as to not incorporate any openable access (e.g., no openable cover/lid/flap included in either of the first or third panels; no perforations or scoring included in either of the first or third panels for defining an openable cover/lid/flap; such that no covering for any receptacle of the pharmaceutical product receiver is accessible when the container is disposed in its second configuration). A first adhesive may be provided on all or a portion of a surface or side of the first panel that is disposable in interfacing relation with a first side of the pharmaceutical product receiver (e.g., the side of the receiver through which the receptacles may be accessed to retrieve pharmaceutical product—the side with one or more coverings). A first release liner may be provided for this first adhesive. A second adhesive may be provided on all or a portion of a surface or side of the third panel that is disposable in interfacing relation with an oppositely disposed second side of the pharmaceutical product receiver. A second release liner may be provided for the second adhesive. The first and second release liners may be moved away from the corresponding adhesive, the first panel may be folded onto and may adhere to the first side of the pharmaceutical product receiver, and the third panel may be folded onto and may adhere to the second side of the pharmaceutical product receiver. In one embodiment, the first and third panels are pivoted in the same general direction (e.g., in an end view of the container, in a common clockwise or counterclockwise direction) to secure the pharmaceutical product receiver between the first and third panels. The pharmaceutical product supply may be in the form of a stack when folded and adhesively joined in the above-noted manner. This particular three-paneled configuration may itself be an independent aspect of the present invention.

Regardless of whether the pharmaceutical product receiver is separately attached to or functions as the second panel of the noted three-paneled container, a number of observations apply. One is that the pharmaceutical product receiver may be "sandwiched" between the first and third panels and should be retained in a stack with the first and third panels by adhesive. As neither the first nor third panels include any openable access (e.g., no openable cover/lid/flap included in either of the first or third panels; no perforations or scoring included in either of the first or third panels for defining an openable cover/lid/flap; such that no covering for any receptacle of the pharmaceutical product receiver is accessible at this time), the pharmaceutical product receiver should be rendered at least substantially inaccessible at this time (e.g., the first panel may be adhered to the side of the pharmaceutical product receiver that incorporates the openings to its various receptacles). Another observation is that pharmaceutical product information, labeling, or the like that may be incorporated on the pharmaceutical product receiver should remain hidden from viewing when the pharmaceutical product receiver is "sandwiched" between and adhered to (directly or indirectly) the first and third panels. One or both of these features should reduce the potential that the pharmaceutical product supply will be "removed from the trash" for purposes of attempting to retrieve unused pharmaceutical product.

The container for the pharmaceutical product supply may be a two-paneled structure (in one embodiment the container includes only two panels). A "fold line" may exist at an intersection between first and second panels. The pharmaceutical product receiver may be incorporated by the second panel in any appropriate manner, and the first panel itself may be configured so as to not incorporate any openable access (e.g., no openable cover/lid/flap included in the first panel; no perforations or scoring included in the first panel for defining an openable cover/lid/flap). The pharmaceutical product receiver could define the second panel. The pharmaceutical product receiver could be separately mounted to the second panel (e.g., via an appropriate adhesive). The second panel could also include an internal storage area that accommodates multiple pharmaceutical product receivers, with an opening thereto facing the first panel when closed onto the second panel. In any case, a first adhesive may be provided on all or a portion of a surface or side of the first panel that is disposable in interfacing relation with a side of the second panel that includes or that provides access to the pharmaceutical product receiver. A first release liner may be provided for this first adhesive. A second adhesive may be provided on all or part of a surface or side of the second panel that includes or that provides access to the pharmaceutical product receiver (e.g., the side of the receiver through which the receptacles may be accessed to retrieve pharmaceutical product—the side with one or more coverings), and that is disposable in interfacing relation with the first panel. A second release liner may be provided for the second adhesive. In the case where the pharmaceutical product receiver is mounted to the second panel, the second disposal adhesive may be disposed on a part of the second panel that extends about the perimeter of the pharmaceutical product receiver. Either of the first and second adhesives could be used (i.e., only one of the adhesives may be required), or each of the first and second adhesives could be used. In any case, once the relevant release liner(s) is removed from the corresponding adhesive, the first panel may be folded onto and may adhere to that side of the second panel that includes or that provides access to the pharmaceutical product receiver (e.g., the side of the receiver through which the receptacles may be accessed to retrieve pharmaceutical product—the side with one or more coverings). As the container does not include any openable access after being disposed in this configuration (e.g., no openable cover/lid/flap; no perforations or scoring included by the container for defining an openable cover/lid/flap; such that no covering for any receptacle of the pharmaceutical product receiver is accessible at this time), the pharmaceutical product receiver should be rendered at least substantially inaccessible at this time (e.g., the first panel may be adhered to the side pharmaceutical product receiver that incorporates the openings to its various receptacles). This particular two-paneled configuration may itself be an independent aspect of the present invention.

Another two-paneled configuration may be used as the container for the pharmaceutical product supply (in one embodiment the container includes only two panels). A boundary region may exist at an intersection between first and second panels (e.g., a "fold line" at an intersection between the first and second panels). In any case, the pharmaceutical product receiver may be incorporated by the second panel in any appropriate manner. The pharmaceutical product receiver could define the second panel. The pharmaceutical product receiver could be separately mounted to the second panel (e.g., via an appropriate adhesive). The second panel could also include an internal storage area that accommodates multiple pharmaceutical product receivers, with an opening thereto facing the first panel when closed onto the second panel. In any case, adhesive may be provided on all or a portion of a surface or side of the first panel that is disposable in interfacing relation with the side of the second panel that includes or that provides access to the pharmaceutical product receiver (e.g., the side of the receiver through which the receptacles may be accessed to retrieve pharmaceutical product—the side with one or more coverings). The release liner in this case is disposed over the adhesive, and furthermore is attached to the first panel at a location that is spaced from the boundary region between the first and second panels (e.g., on an opposite end of the first panel in relation to that which may adjoin the second panel). In this case and once the release liner is moved away from the adhesive, the first panel may be folded onto and may adhere to that side of the second panel that includes or that provides access to the pharmaceutical product receiver (e.g., the side of the receiver through which the receptacles may be accessed to retrieve pharmaceutical product—the side with one or more coverings). The first panel, or at least the release liner that now extends therefrom, may be wrapped around an end section of the second panel (which could simply be an edge, although it could be a surface of any appropriate contour), and in any case may be adhered to the side of the second panel that is opposite that which includes or that provides access to the pharmaceutical product receiver. As the container does not include any openable access after being disposed in this configuration (e.g., no openable cover/lid/flap; no perforations or scoring included by the container for defining an openable cover/lid/flap; such that no covering for any receptacle of the pharmaceutical product receiver is accessible at this time), the pharmaceutical product receiver should be rendered at least substantially inaccessible at this time. This particular two-paneled configuration may itself be an independent aspect of the present invention.

Another multi-paneled configuration may be used as the container for the pharmaceutical product supply. A boundary region may exist at an intersection between first and second panels (e.g., a "fold line" at an intersection between the first and second panels). In any case, the pharmaceutical product receiver may be incorporated by the second panel in any appropriate manner. The pharmaceutical product receiver could define the second panel. The pharmaceutical product receiver could be separately mounted to the second panel (e.g., via an appropriate adhesive). The second panel could also include an internal storage area that accommodates multiple pharmaceutical product receivers, with an opening thereto facing the first panel when closed onto the second panel.

The first panel may actually be in the form of first and second panel sections in this embodiment. One end of the first panel section may be separated from the second panel by a boundary region (e.g., a fold line). An opposite and free end of the first panel section may be separated from its end that may adjoin the second panel section. The second panel section may be folded onto the first panel section. Adhesive may be provided on all or a portion of the surfaces of the first and second panel sections that are disposable in interfacing relation (e.g., that may be folded onto one another). One or more release liners in this case may be disposed over the adhesive on the two noted surfaces of the first and second panel sections. The second panel section may be moved away from the first panel section (e.g., to move the first panel toward or into an extended configuration). Each release liner for the adhesive on the first and second panel sections may be moved to expose the adhesive. The first panel section may be folded onto and may adhere to that side of the second panel that includes or that provides access to the pharmaceutical product receiver (e.g., the side of the receiver through which the receptacles may be accessed to retrieve pharmaceutical product—the side with one or more coverings). The first panel section, or the second panel section that now extends therefrom, may be wrapped around an end section of the second panel (which could simply be an edge, although it could be a surface of any appropriate contour). At least part of the second panel section may be adhered to the side of the second panel that is opposite that which includes or that provides access to the pharmaceutical product receiver. As the container does not include any openable access after being disposed in this configuration (e.g., no openable cover/lid/flap; no perforations or scoring included by the container for defining an openable cover/lid/flap; such that no covering for any receptacle of the pharmaceutical product receiver is accessible at this time), the pharmaceutical product receiver should be rendered at least substantially inaccessible at this time. This particular two-paneled configuration may itself be an independent aspect of the present invention.

Another option is for the container to include an internal storage area, along with an opening that provides access to this internal storage area and a cover that selectively blocks this opening. One or more pharmaceutical product receivers they be positioned within this internal storage area. The cover may include the adhesive and the release liner. Once this release liner is removed and the cover is adhered to a portion of the container body so as to selectively block the opening, and as the container does not include any openable access after being disposed in this configuration (e.g., no openable cover/lid/flap; no perforations or scoring included by the container for defining an openable cover/lid/flap; such that no covering for any receptacle of the pharmaceutical product receiver is accessible at this time), the pharmaceutical product receiver should be rendered at least substantially inaccessible at this time.

Yet another option is for the container to include first and second panels that are disposed in spaced relation, an internal storage area between the first and second panels, and an opening that provides access to this internal storage area. An inner surface of at least one of the first and second panels may include adhesive and a corresponding release liner. This particular configuration may itself be an independent aspect of the present invention. In any case, the release liner may "double back" on itself. Consider the case where one end of the release liner is positioned on or adjacent to the start of the adhesive. The release liner may extend toward a closed end of the container and in overlying relation to the adhesive, and then "double back" on itself toward the opening of the container. In one embodiment, the "doubling back" section of the release liner extends through and beyond the opening of the container for grasping by a patient or other user. Once the release liner is removed, the container may be disposed in a configuration where the covering for none of the plurality of receptacles is accessible through any openable access of the container.

Consider the case where only the interior surface of the first panel includes adhesive and the noted "doubling back" release liner. When the release liner is removed in this case, the side of the pharmaceutical product receiver that incorporates the openings for its various receptacles may be disposed in interfacing relation with this adhesive to bond this side of the pharmaceutical product receiver to the interior surface of the first panel. As the first panel does not include any openable access (e.g., no openable cover/lid/flap; no perforations or scoring included in the first panel for defining an openable cover/lid/flap; such that no covering for any receptacle of the pharmaceutical product receiver is accessible at this time), the pharmaceutical product receiver should be rendered at least substantially inaccessible at this time. If the container is formed so as to not be easily ruptured, torn, or the like, either side of the pharmaceutical product receiver could be bonded to the interior surface of the first panel to become bonded within the interior of the container and rendered at least substantially inaccessible (e.g., such that no covering for any receptacle of the pharmaceutical product receiver is accessible at this time).

Now consider the case where the interior surface of each of the first and second panels includes adhesive and a corresponding "doubling back" release liner. When the two release liners are removed in this case and a single pharmaceutical product receiver is disposed within the interior of the container, the first and second panels may be pressed together to adhere this single pharmaceutical product receiver therebetween (e.g., to define a stack, with the pharmaceutical product receiver being interiorly disposed within the stack, such that any remaining pharmaceutical product is at least substantially inaccessible). As neither the first nor second panel includes any openable access (e.g., no openable cover/lid/flap included in either of the first or second panels; no perforations or scoring included in either of the first or second panels for defining an openable cover/lid/flap; such that no covering for any receptacle of the pharmaceutical product receiver is accessible at this time), the single pharmaceutical product receiver within this bonded stack should be rendered at least substantially inaccessible at this time.

If two pharmaceutical product receivers are within a container that utilizes two doubling back release liners in accordance with the foregoing, and both release liners are removed, the side of one pharmaceutical product receiver that incorporates the openings for its various receptacles may be disposed in interfacing relation with adhesive to bond this side of the pharmaceutical product receiver to the interior surface of the first panel, and the side of the second pharmaceutical product receiver that incorporates the openings for its various receptacles may be disposed in interfacing relation with adhesive to bond this side of the pharmaceutical product receiver to the interior surface of the second panel. As neither the first nor second panels include any openable access (e.g., no openable cover/lid/flap included in either of the first or second panels; no perforations or scoring included in either of the first or second panels for defining an openable cover/lid/flap; such that no covering for any receptacle of the pharmaceutical product receiver is accessible at this time), the two pharmaceutical product receivers bonded within the interior of the container should be rendered at least substantially inaccessible. If the container is formed so as to not be easily ruptured, torn, or the like, either side of each pharmaceutical product receiver could be bonded to the interior surface of the corresponding first or second panel to become bonded within the interior of the container and rendered at least substantially inaccessible (e.g., such that no covering for any receptacle of the pharmaceutical product receiver is accessible at this time).

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a pharmaceutical product supply includes "a pharmaceutical product receiver" alone does not mean that the pharmaceutical product supply includes only a single pharmaceutical product receiver). Moreover, any failure to use phrases such as "at least one" also does not limit the corresponding feature to the singular (e.g., indicating that pharmaceutical product supply includes "a pharmaceutical product receiver" alone does not mean that the pharmaceutical product supply includes only a single pharmaceutical product receiver). Use of the phrase "at least generally" or the like in relation to a particular feature encompasses the corresponding characteristic and insubstantial variations thereof (e.g., indicating that a panel is at least generally flat encompasses the panel being flat). Finally, a reference of a feature in conjunction with the phrase "in one embodiment" does not limit the use of the feature to a single embodiment.

A "pharmaceutical product" as used herein may generally define any material or substance used in the course of a medical treatment, medical diagnosis, therapy, or the provision of any other appropriate medical care. A given material need not contain an active drug compound or ingredient to be considered a "pharmaceutical product" for purposes of the present invention. In one embodiment, each pharmaceutical product is in the form of a pill (e.g., a tablet or capsule).

A pharmaceutical product within the receptacles of the pharmaceutical product receiver may be in any appropriate form, in any appropriate dose, and of any appropriate type. A pharmaceutical product encompasses both a single-dose configuration (e.g., a single pill) and a multiple dose configuration (e.g., a plurality of pills). Pharmaceutical product may be in any appropriate form such as (but not limited to) pills, tablets, chewables, capsules, or the like. Further, a "pharmaceutical product" may refer to or include any "drug" as defined in Title 21 of the United States Code, Section 321(g)(1).

DETAILED DESCRIPTION

Figure 1A:
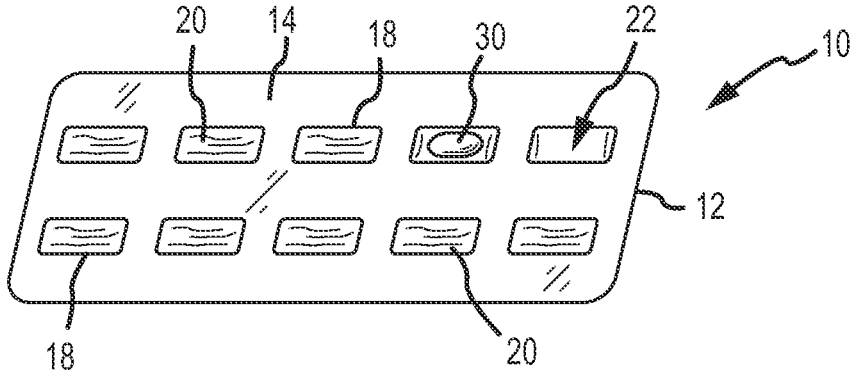
FIG. 1A is a top view of a representative blister card.
Figure 1B:
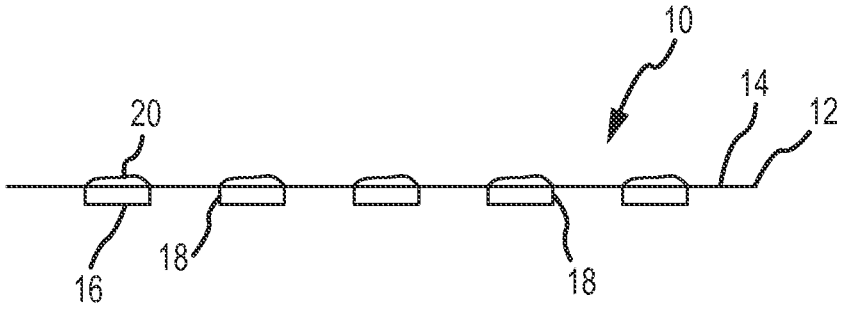
FIG. 1B is a side view of the blister card of FIG. 1A.
Figure 1C:
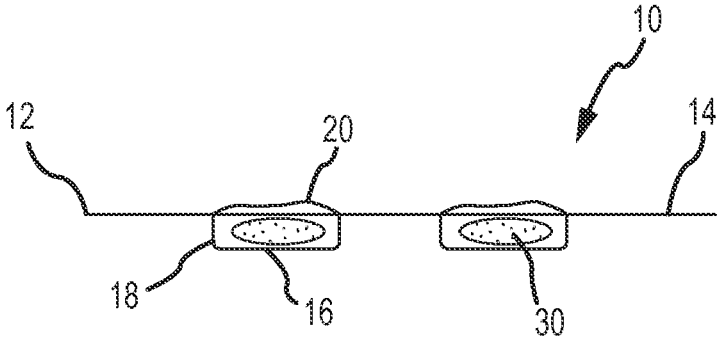
FIG. 1C is an end view of the blister card of FIG. 1A.

A representative blister card or pack is shown in FIGS. 1A, 1B, and 1C, and is identified by reference numeral 10. The blister card 10 includes a tray 12 (e.g., a pre-formed structure, for instance plastic) having a plurality of receptacles 18. Any number of receptacles 18 may be utilized by the tray 12, and these receptacles 18 may be disposed in any appropriate arrangement. In the illustrated embodiment, there are two rows and five columns of receptacles 18. Any number of rows and columns may be utilized. Any arrangement of receptacles 18 may be utilized by the blister card 10.

Pharmaceutical product 30 may be disposed in each receptacle 18 of the blister card 10, and as such the blister card 10 may be referred to as "primary packaging" for the pharmaceutical product 30. A covering 20 is disposed over each receptacle 18 to enclose the corresponding pharmaceutical product 30 (the covering 20 being "puckered" in FIGS. 1B and 1C to distinguish the same from the tray 12, although the covering 20 could be at least substantially coplanar with the upper surface 14 of the tray 12). Although a single covering could extend over an entirety of an upper surface 14 of the tray 12 (or at least over each of the various receptacles 18), in the illustrated embodiment each receptacle 18 has its own individual covering 20. Any covering 20 for the blister card 10 may be in the form of a film, foil, paper, a sheet-like material, or the like. Generally, pharmaceutical product 30 may be removed from a given receptacle 18 by pushing on a lower surface 16 of the tray 12 (more specifically a receptacle 18), which in turn may push the pharmaceutical product 30 against the associated covering 20 with a sufficient force so as to rupture the covering 20. The covering 20 could also be "peeled" away from the tray 12 to gain access to pharmaceutical product 30 within a receptacle 18. Any way of gaining access to the pharmaceutical product 30 in a given receptacle 18, enclosed by a covering 20, may be implemented by the blister card 10.

Each receptacle 18 may be characterized as having a corresponding opening 22. The covering 20 for a corresponding receptacle 18 may be characterized as blocking this opening 22 (e.g., to enclose pharmaceutical product 30 within the corresponding receptacle 18). In the illustrated embodiment, the opening 22 for each receptacle 18 is disposed on a common side of the tray 12, namely its upper surface 14.

Blister cards 10 may be utilized by various pharmaceutical products supplies to be addressed herein (e.g., a combination of secondary packaging of a variety of configurations, together with one or more blister cards 10 (e.g., primary packaging)). Each of these embodiments is directed to a pharmaceutical product supply that includes a container, a pharmaceutical product receiver, pharmaceutical product, an adhesive, and at least one release liner. The pharmaceutical product receiver includes a plurality of pockets or receptacles, and pharmaceutical product may be enclosed within each of these receptacles. The adhesive is provided on the container, on the pharmaceutical product receiver, or on each of the container and the pharmaceutical product receiver, and a release liner is positioned over the adhesive. The container is initially disposed in a first configuration where at least one (including all) of the pharmaceutical product receiver receptacles are accessible. The container is thereafter disposable in a second configuration where none of the pharmaceutical product receiver receptacles are accessible through any openable access incorporated by the container. One or more release liners may be moved to expose the adhesive for disposing and retaining the container in its second configuration (where none of the pharmaceutical product receiver receptacles are accessible through any openable access incorporated by the container). The noted second configuration of the container facilitates disposal of the pharmaceutical product supply (e.g., now being in a form that should reduce the potential for gaining access to any remaining pharmaceutical product still enclosed within the pharmaceutical product receiver). At the time of disposal, typically one or more of the pharmaceutical product receiver receptacles will be empty (the pharmaceutical product having been previously removed therefrom), while at least one of the receptacles will still have pharmaceutical product enclosed therein.

Figure 2:
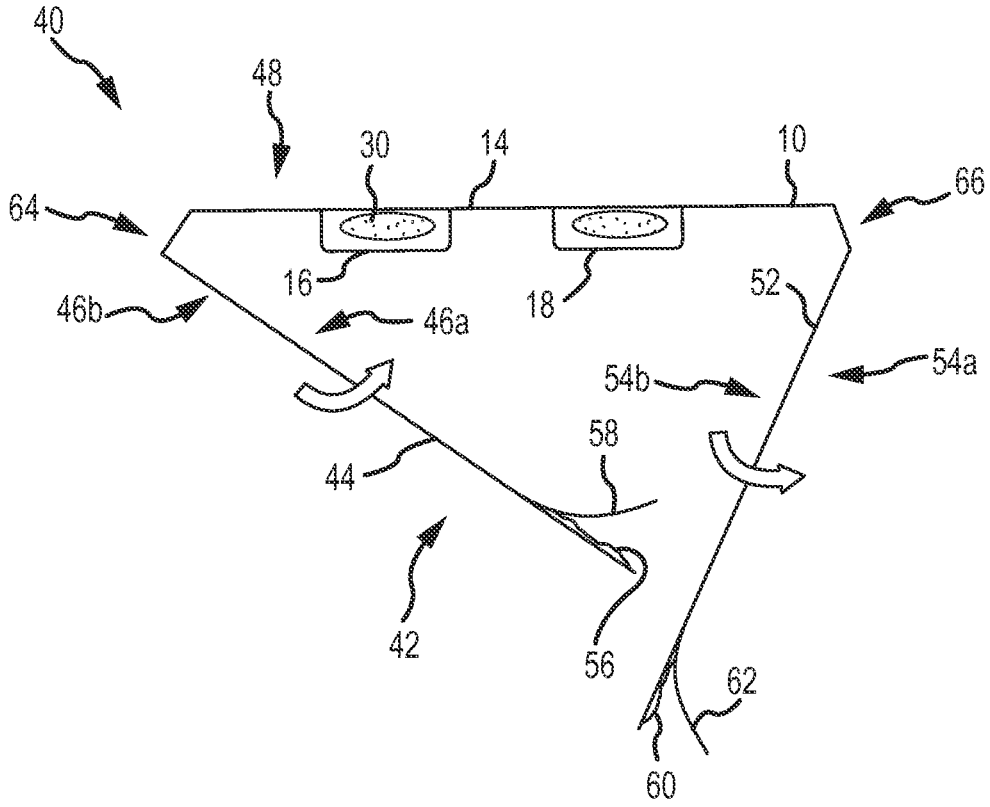
FIG. 2 is an end view of one embodiment of a pharmaceutical product supply that utilizes a three-panel structure that may seal a pharmaceutical product receiver between a pair of panels to facilitate disposal.

One embodiment of such a pharmaceutical product supply is illustrated in FIG. 2 and is identified by reference numeral 40. The pharmaceutical product supply 40 includes a container 42 in the form of a three-paneled structure (only three panels in the illustrated embodiment). The container 42 includes a first panel 44, a second panel 48, and a third panel 52. The second panel 48 is located between the first panel 44 and the third panel 52. A boundary region 64 (e.g., an intersection or fold line) exists between the first panel 44 and the second panel 48. A boundary region 66 (e.g., an intersection or fold line) exists between the second panel 48 and the third panel 52.

The second panel 48 may incorporate a blister card 10 in any appropriate manner. In the illustrated embodiment, the blister card 10 functions as the second panel 48. However, a blister card 10 could also be separately attached or mounted to the second panel 48. Each of the first panel 44 and the third panel 52 are configured so as to not incorporate any openable access (e.g., no openable cover/lid/flap included in either of the first or third panels 44, 52; no perforations or scoring included in either of the first or third panels 44, 52 for defining an openable cover/lid/flap).

The first panel 44 includes a first surface 46*a* and an oppositely disposed second surface 46*b*. A first adhesive 56 is provided on at least part of the first surface 46*a* of the first panel 44. A first release liner 58 is provided for the first adhesive 56. The third panel 52 includes a first surface 54*a* and an oppositely disposed second surface 54*b*. A second adhesive 60 is provided on at least part of the first surface 54*a* of the third panel 52. A second release liner 62 is provided for the second adhesive 60. Prior to removing the release liners 58, 62, the first panel 44 may be pivoted in the direction indicated by the corresponding arrow in FIG. 2 and the third panel 52 may be pivoted in the direction indicated by the corresponding arrow in FIG. 2 to dispose the container 42 in a configuration for storing the blister card 10 between dosing events.

The release liners 58, 62 may be removed from the corresponding adhesive 56, 60 in preparation for disposal of the blister card 10 (e.g., to dispose the container 42 in a configuration for disposal with unused pharmaceutical product 30 remaining in one or more blister cards 10). With the first release liner 58 being moved away from the first surface 46*a* of the first panel 44, the first panel 44 may be pivoted in the direction indicated by the associated arrow so that its first surface 46*a* comes into contact with one side of the second panel 48 (the side of the second panel 48 that includes a lower surface 16 of the tray 12 of the blister card 10 in the illustrated configuration). With the second release liner 62 being moved away from the first surface 54*a* of the third panel 52, the third panel 52 may be pivoted in the direction indicated by the associated arrow so that its first surface 54*a* comes into contact with an opposite side of the second panel 48 (the side of the second panel 48 that includes the upper surface 14 of the tray 12 of the blister card 10 in the illustrated configuration; the side of the blister card 10 that includes the one or more coverings 20). As the container 42 does not include any openable access after being disposed in this configuration (e.g., no openable cover/lid/flap; no perforations or scoring included by the container 42 for defining an openable cover/lid/flap; such that no covering 20 for any receptacle 18 of the blister card 10 is accessible at this time), the blister card 10 should be rendered at least substantially inaccessible at this time.

Bonding the third panel 52 to the side of the blister card 10 that includes the openings 22 (and any remaining coverings 20; e.g., its upper surface 14) in the above-noted manner, should reduce the potential of pharmaceutical product 30 thereafter being removed from the blister card 10 (e.g., such that no covering 20 for any receptacle 18 of the blister card 10 is accessible at this time). Bonding the third panel 52 and bonding the first panel 44 to opposite sides of the blister card 10, and in the above-noted manner, disposes the blister card 10 within the interior of a stack (e.g., collectively, the first panel 44, the second panel 48, and the third panel 52), which should reduce the potential of pharmaceutical product 30 thereafter being removed from the blister card 10 (e.g., such that no covering 20 for any receptacle 18 of the blister card 10 is accessible at this time).

Figure 3:
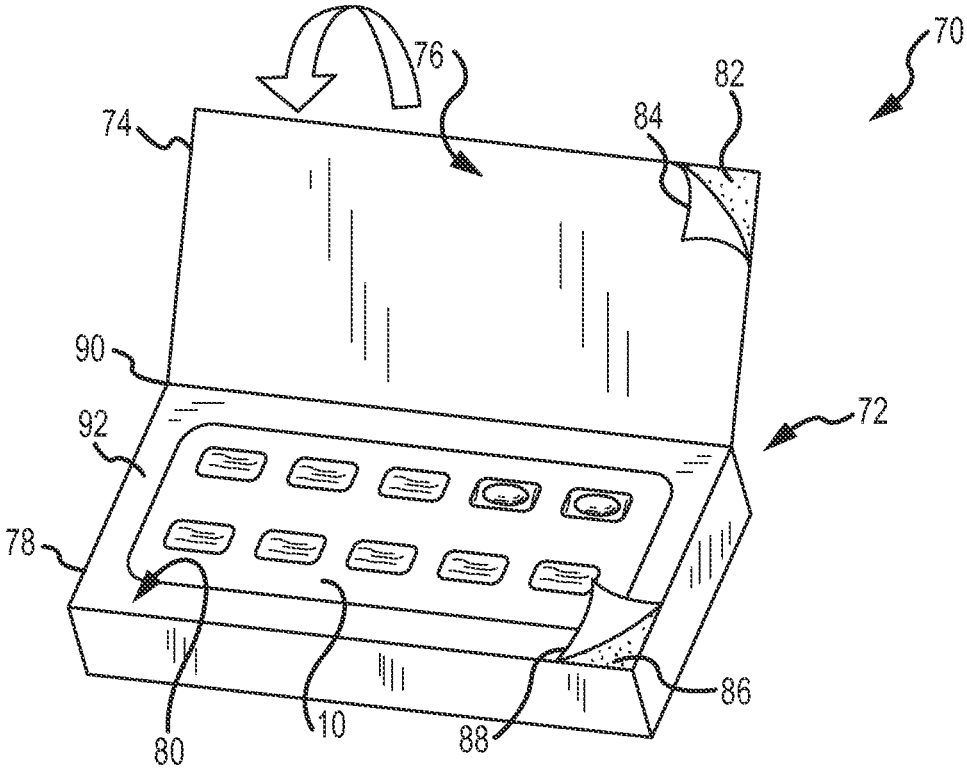
FIG. 3 is a perspective view of one embodiment of a pharmaceutical product supply that utilizes a two-panel structure that may seal a pharmaceutical product receiver between a pair of panels to facilitate disposal.

Another embodiment of a pharmaceutical product supply is illustrated in FIG. 3 and is identified by reference numeral 70 (only two panels in the illustrated embodiment). The pharmaceutical product supply 70 includes a container 72 in the form of a two-paneled structure. The container 72 includes a first panel 74 and a second panel 78. An intersection or fold line 90 exists between the first panel 74 and the second panel 78.

The first panel 74 includes a first surface 76. A first adhesive 82 is included on all or part of this first surface 76. A first release liner 84 is disposed over the first adhesive 82. The first panel 74 is configured so as to not incorporate any openable access (e.g., no openable cover/lid/flap included in the first panel 74; no perforations or scoring included in the first panel 74 for defining an openable cover/lid/flap).

The second panel 78 may accommodate a blister card 10 in any appropriate manner. For instance, a blister card 10 could be separately attached to the second panel 78. The second panel 78 could also be in the form of a hollow structure or the like that includes an internal storage area to accommodate one or more blister cards 10 (e.g., and that may be accessed by an opening which may coincide with the intersection between the perimeter of the blister card 10 and the second panel 78 in the view shown in FIG. 3). In any case, all or part of a perimeter region 92 on a surface 80 of the second panel 78 may include a second adhesive 86. A second release liner 88 is disposed over the second adhesive 86. Although both adhesives 82, 86 may be utilized and as illustrated in FIG. 3, it may be possible to only utilize one of the adhesives 82, 86. Prior to removing the release liners 84, 88, the first panel 74 may be pivoted in the direction indicated by the corresponding arrow in FIG. 3 to dispose the container 72 in a configuration for storing one or more blister cards 10 between dosing events.

The release liners 84, 88 may be moved away from the corresponding adhesive 82, 86 in preparation for disposal of the associated blister card(s) 10 (e.g., to dispose the container 72 in a configuration for disposal with unused pharmaceutical product 30 remaining in one or more blister cards 10). With the first release liner 84 being moved away from the first surface 76 of the first panel 74, and with the second release liner 88 being moved away from the first surface 80 of the second panel 78, the first panel 74 may be pivoted in the direction indicated by the associated arrow so that its first surface 76 comes into contact with at least the perimeter region 92 of the second panel 78 (the side of the second panel 78 that includes or provides access to at least one blister card 10 in the illustrated configuration; the side of the blister card 10 that includes the one or more coverings 20). As the container 72 does not include any openable access after being disposed in this configuration (e.g., no openable cover/lid/flap; no perforations or scoring included by the container 72 for defining an openable cover/lid/flap; such that no covering 20 for any receptacle 18 of the blister card 10 is accessible at this time), the blister card 10 should be rendered at least substantially inaccessible at this time.

Bonding the first panel 74 to the side of the blister card 10 that includes the openings 22 (and any remaining coverings 20; e.g., its upper surface 14), bonding the first panel 74 to the perimeter region 92, or both, should reduce the potential of pharmaceutical product 30 thereafter being removed from any blister card 10 within or incorporated by the container 72 (e.g., such that no covering 20 for any receptacle 18 of the blister card 10 is accessible at this time). Bonding the first panel 74 in the noted manner disposes one or more blister cards 10 within the interior of the container 72, which should reduce the potential of pharmaceutical product 30 thereafter being removed from any such blister card(s) 10 (e.g., such that no covering 20 for any receptacle 18 of the blister card 10 is accessible at this time).

Figure 4A:
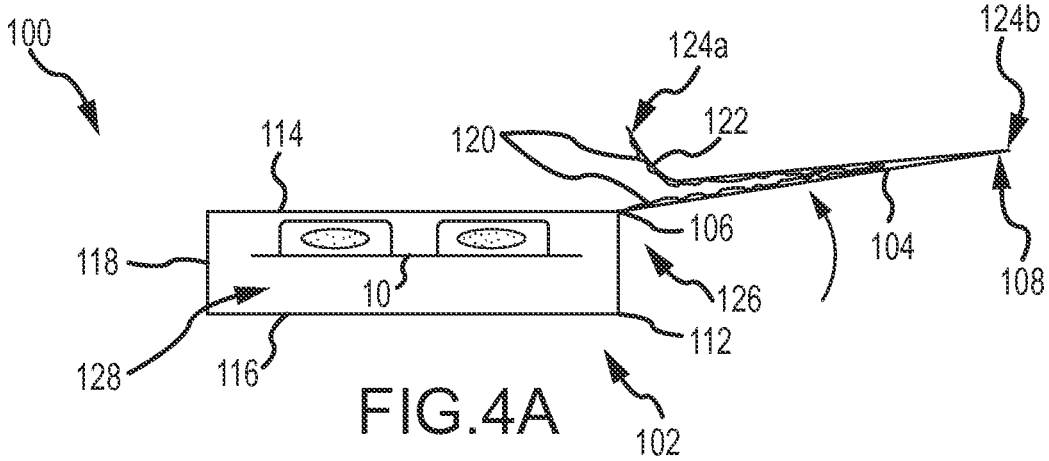
FIGS. 4A-C are sequential end views of one embodiment of a pharmaceutical product supply that utilizes another two-panel structure that may seal a pharmaceutical product receiver between a pair of panels to facilitate disposal.
Figure 4B:
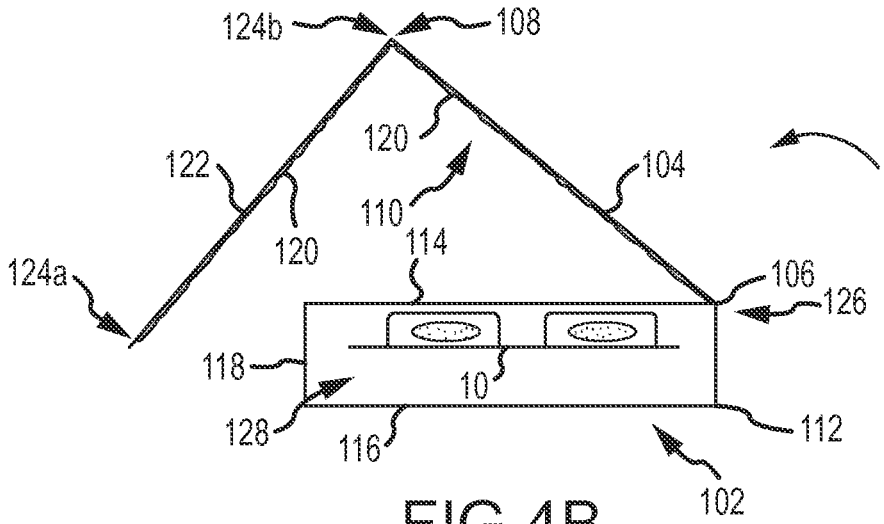
Figure 4C:
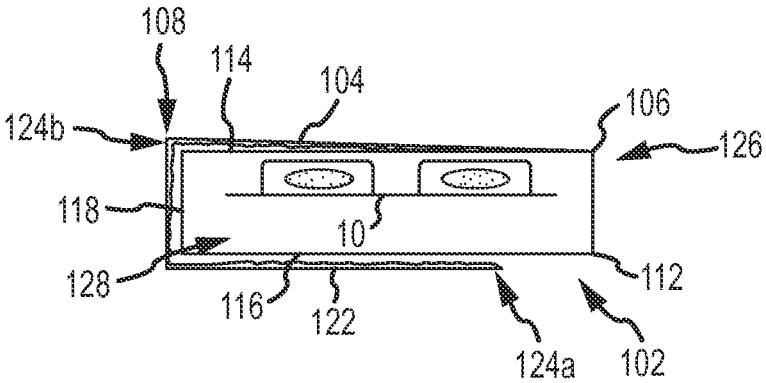

Another embodiment of a pharmaceutical product supply is illustrated in FIGS. 4A-C and is identified by reference numeral 100. The pharmaceutical product supply 100 includes a container 102 in the form of a two-paneled structure. The container 102 includes a first panel 104 and a second panel 112. An intersection or fold line 126 may exist between the first panel 104 and the second panel 112.

The first panel 104 includes a first surface 110. An adhesive 120 is included on all or part of this first surface 110. A release liner 122 is disposed over the adhesive 120. The first panel 104 may be characterized as having a pair of oppositely disposed ends 106, 108. The end 106 is disposed at the intersection 126 with the second panel 112. One end 124*b* of the release liner 122 is attached to the first panel 104 at or near its free end 108 (more generally, at a location spaced from where the first panel 104 adjoins the second panel 112). The other end 124*a* of the release liner 122 is "free" so that the release liner 122 may be pulled away from the adhesive 120 on the first surface 110 of the first panel 104.

The second panel 112 may accommodate a blister card 10 in any appropriate manner. For instance, a blister card 10 could be separately attached to the second panel 112 (not shown). The second panel 112 could also be in the form of a hollow structure or the like that includes an internal storage area 128 to accommodate one or more blister cards. A front side 114 of the second panel 112 may include an opening to provide access to the internal storage area 128. A back side 116 of the second panel 112 is disposed opposite of the front side 114. Prior to moving the release liner 122 away from the first surface 110 of the first panel 104, the first panel 104 (along with the release liner 122) may be pivoted in the direction indicated by the corresponding arrow in FIG. 4A so as to be disposed in overlying relation to the second panel 112, to in turn dispose the container 102 in a configuration for storing one or more blister cards 10 between dosing events.

The release liner 122 may be moved to expose the adhesive 120 on the first surface 110 of the first panel 104 in preparation for disposal of the associated blister card(s) 10 (e.g., to dispose the container 102 in a configuration for disposal with unused pharmaceutical product 30 remaining in one or more blister cards 10). A patient or other user may grab the free end 124*a* of the release liner 122 (FIG. 4A) and pull the same away from the first surface 110 of the first panel 104. However, the release liner 122 extends from and remains attached to the first panel 104 (e.g. FIG. 4B). Adhesive 120 may exist on the release liner 122 as well. With the first release liner 122 being moved away from the first surface 110 of the first panel 104, the first panel 104 may be pivoted in the direction indicated by the associated arrow (FIGS. 4A and 4B) so that its first surface to 110 comes into contact with the front side 114 of the second panel 112 (the side of the second panel 112 that includes or provides access to at least one blister card 10 in the illustrated configuration). The release liner 122 (again attached to or extending from first panel 104 at a location spaced from its intersection 126 with the second panel 112) may be pulled around an end section 118 of the second panel 112 and may be disposed against and adhered to at least part of the back side 116 of the second panel 112. As the container 102 does not include any openable access after being disposed in this configuration (e.g., no openable cover/lid/flap; no perforations or scoring included by the container 102 for defining an openable cover/lid/flap; such that no covering 20 for any receptacle 18 of the blister card 10 is accessible at this time), the blister card 10 should be rendered at least substantially inaccessible at this time.

Bonding the first surface 110 of the first panel 104 to the front side 114 of the second panel 112, bonding the release liner 122 to the back side 116 of the second panel 112, or both, should reduce the potential of pharmaceutical product 30 thereafter being removed from any blister card 10 within or incorporated by the container 102 (e.g., such that no covering 20 for any receptacle 18 of the blister card 10 is accessible at this time). Bonding the first surface 110 of the first panel 104 to the front side 114 of the second panel 112, bonding the release liner 122 to the back side 116 of the second panel 112, or both, disposes one or more blister cards 10 within the interior of the container 102, which should reduce the potential of pharmaceutical product 30 thereafter being removed from any such blister card 10 (e.g., such that no covering 20 for any receptacle 18 of the blister card 10 is accessible at this time).

Figure 5A:
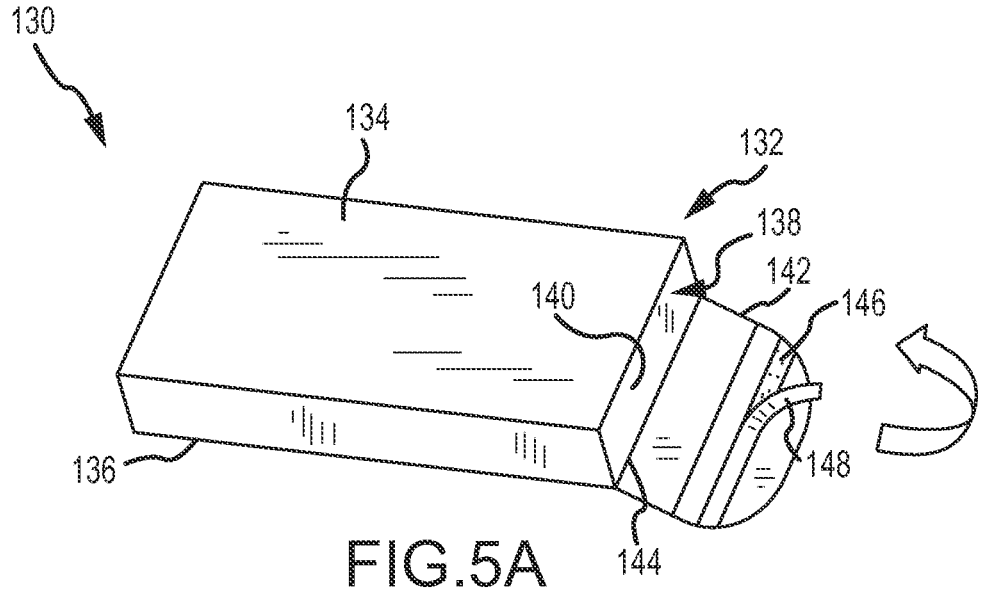
FIGS. 5A-B are sequential perspective views of one embodiment of a pharmaceutical product supply that utilizes a sealable carton that may be adhesively sealed to enclose a pharmaceutical product receiver to facilitate disposal.
Figure 5B:
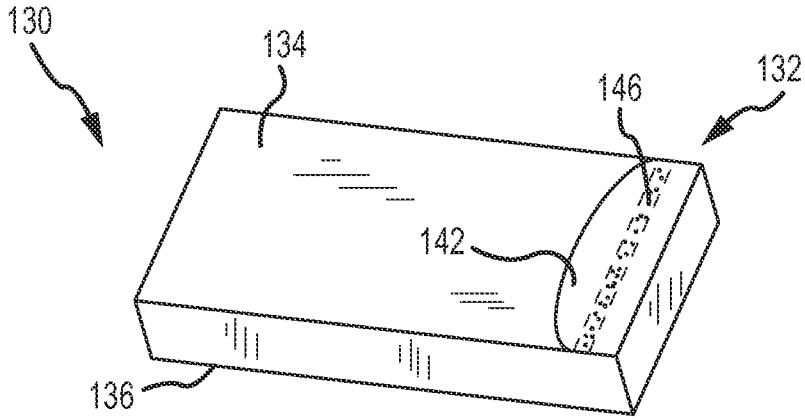

Another embodiment of a pharmaceutical product supply is illustrated in FIGS. 5A-B and is identified by reference numeral 130. The pharmaceutical product supply 130 includes a container 132. A first panel 134 and a second panel 136 of the container 132 are disposed in spaced relation (e.g. parallel to one another) and define at least part of an internal storage area 138. The container 132 further includes an opening 140 to provide access to this internal storage area 138. One or more blister cards 10 may be kept in the internal storage area 138.

The container 132 also includes a cover 142 for selectively opening/closing the opening 140. This cover 142 may extend from an end of the second panel 136. A fold line 144 may exist at the intersection of the cover 142 with the second panel 136.

At least part of the cover 142 includes an adhesive 146. A release liner 148 is positioned over the adhesive 146. Prior to removing the release liner 148, the cover 142 (along with the release liner 148) may be pivoted in the direction indicated by the corresponding arrow in FIG. 5A such that its free end is disposed within the internal storage area 138, to in turn dispose the container 132 in a configuration for storing one or more blister cards 10 between dosing events.

The release liner 148 may be moved to expose the adhesive 146 on the cover 142 in preparation for disposal of any blister card(s) 10 contained within the internal storage area 138 (e.g., to dispose the container 132 in a configuration for disposal with unused pharmaceutical product 30 remaining in one or more blister cards 10). The cover 142 may be pivoted in the direction indicated by the arrow in FIG. 5A so that the cover 142 may be disposed in engagement with and adhered to an external side of the first panel 134 of the container 132 (FIG. 5B). As the container 132 does not include any openable access after being disposed in this configuration (e.g., no openable cover/lid/flap; no perforations or scoring included by the container 132 for defining an openable cover/lid/flap; such that no covering 20 for any receptacle 18 of the blister card 10 is accessible at this time), each blister card 10 within the internal storage area 138 should be rendered at least substantially inaccessible at this time.

Bonding the cover 142 to the external side of the first panel 134 (FIG. 5B configuration) should reduce the potential of pharmaceutical product 30 thereafter being removed from any blister card 10 within or incorporated by the container 132 (e.g., such that no covering 20 for any receptacle 18 of the blister card 10 is accessible at this time). Bonding the cover 142 to the external side of the first panel 134 disposes one or more blister cards 10 within the interior of the container 132, which should reduce the potential of pharmaceutical product 30 thereafter being removed from any such blister card(s) 10 (e.g., such that no covering 20 for any receptacle 18 of the blister card 10 is accessible at this time).

Figure 6A:
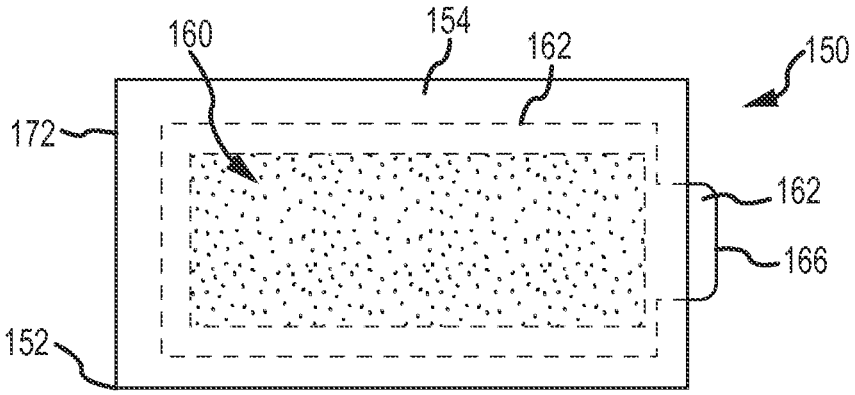
FIG. 6A-C are sequential views of one embodiment of a pharmaceutical product supply that utilizes a carton with an internally-disposed adhesive to secure a pharmaceutical product receiver therein to facilitate disposal.
Figure 6B:
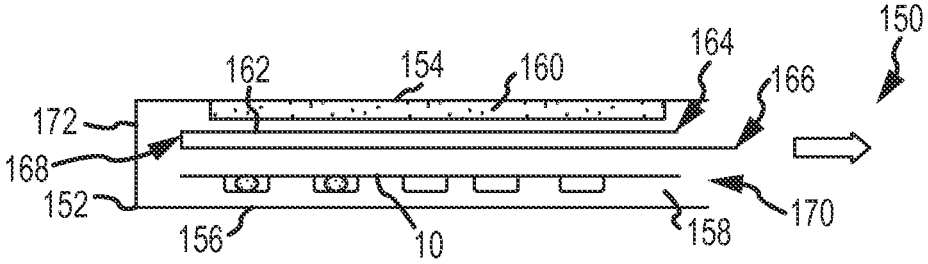
Figure 6C:
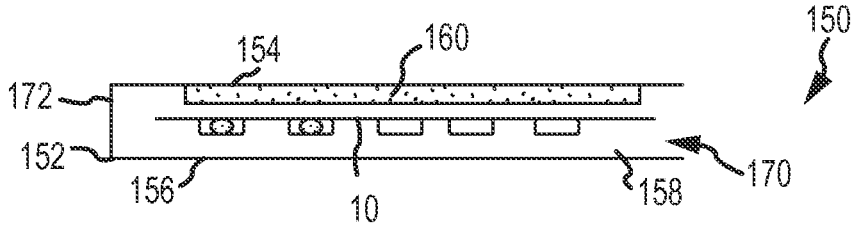

Another embodiment of a pharmaceutical product supply is illustrated in FIGS. 6A-C and is identified by reference numeral 150. The pharmaceutical product supply 150 includes a container 152. A first panel 154 and a second panel 156 of the container 152 are disposed in spaced relation (e.g. parallel to one another) and define at least part of an internal storage area 158. The container 152 further includes an opening 170 to provide access to this internal storage area 158. One or more blister cards 10 may be kept in the internal storage area 158.

Adhesive 160 is included on all or part of an inside wall of the first panel 154 (that wall or surface of the first panel 154 which interfaces with the internal storage area 158). A release liner 162 is positioned over this adhesive 160 (shown in spaced relation in FIG. 6B for clarity, but the release liner 162 will actually be positioned on this adhesive 160). Prior to removing the release liner 162, the container 152 is in a configuration for storing one or more blister cards 10 between dosing events.

The release liner 162 may utilize a "doubling-back" configuration. Referring to FIG. 6B, the release liner 162 may extend from one of its ends 164 toward a closed container end 172 of the container 152, and may be positioned on the adhesive 160. At location 168, the release liner 162 "doubles back" toward the container opening 170 where it terminates at a free end 166. In the illustrated embodiment, the end 164 of the release liner 162 is located between it free end 166 and the closed container end 172 (in a dimension coinciding with a spacing between the container opening 170 and the closed container end 172). In the illustrated embodiment, the doubling-back portion of the release liner 162 extends through and past the container opening 170 such that its free end 166 is located outside of the internal storage area 158 of the container 152.

The free end 166 of the release liner 162 may be pulled away from the container 152 so as to expose the adhesive 160 on the inside wall of the first panel 154 in preparation for disposal of each blister card 10 contained within the internal storage area 158 (e.g., to dispose the container 152 in a configuration for disposal with unused pharmaceutical product 30 remaining in a single blister card 10). This configuration is shown in FIG. 6C. The container 152 thereafter may be compressed in a direction corresponding with the spacing between the first panel 154 and the second panel 156 (i.e., to reduce the spacing between the first panel 154 and second panel 156) so that the blister pack 10 is brought into engagement with and adheres to the inside wall or surface of the first panel 154. As the container 152 does not include any openable access after being disposed in this configuration (e.g., no openable cover/lid/flap; no perforations or scoring included by the container 152 for defining an openable cover/lid/flap; such that no covering 20 for any receptacle 18 of the blister card 10 is accessible at this time), the blister card 10 should be rendered at least substantially inaccessible at this time.

When the release liner 162 is removed in the case of the container 152 of FIGS. 6A-C, the side of the blister card 10 that incorporates the openings 22 for its various receptacles 18 (and any remaining coverings 20; e.g., its upper surface 14) may be disposed in interfacing relation with the adhesive 160 on the inside wall of the first panel 154 to bond this side of the blister card 10 to the interior surface of the first panel 154 (e.g., such that no covering 20 for any receptacle 18 of the blister card 10 is accessible at this time). Again, FIG. 6C shows the blister card 10 prior to actually being bonded to the inside wall of the first panel 154. Bonding the blister card 10 to the first panel 154 in the noted manner disposes the blister card 10 within the internal storage area 170 of the container 152, which should reduce the potential of pharmaceutical product 30 thereafter being removed from such a blister card 10 (e.g., such that no covering 20 for any receptacle 18 of the blister card 10 is accessible at this time). If the container 152 is formed so as to not be easily ruptured, torn, or the like, either side of the blister card 10 could be bonded to the inside wall of the first panel 154 to become bonded within the interior of the container 152 and rendered at least substantially inaccessible (e.g., such that no covering 20 for any receptacle 18 of the blister card 10 is accessible at this time).

Figure 6D:
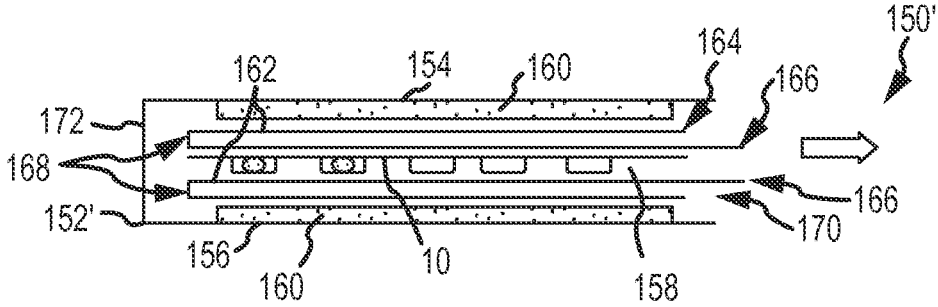
FIG. 6D-E are sequential views of a variation of the embodiment of FIGS. 6A-C.
Figure 6E:
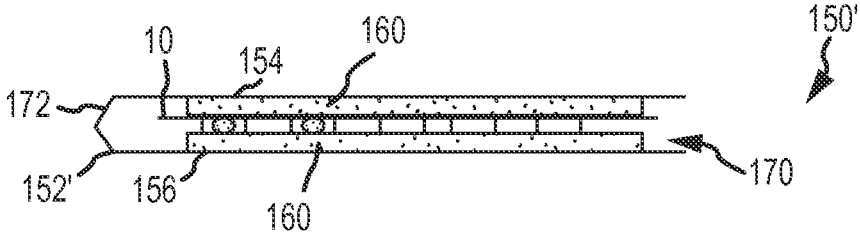

Another embodiment of a pharmaceutical product supply is illustrated in FIGS. 6D-E, is a variation of the pharmaceutical product supply 150 of FIGS. 6A-C, and is identified by reference numeral 150'. Corresponding components between the embodiment of FIGS. 6A-C and the embodiment of FIGS. 6D-E are identified by the same reference numeral. Those corresponding components that differ in at least some respect are identified by a "single prime" designation in FIGS. 6D-E. In this regard, the primary distinction between these embodiments is that the container 152' in the embodiment of FIGS. 6D-E also includes adhesive 160 on the inside wall of the second panel 156, along with a corresponding release liner 162 of the above-noted type/configuration. Each release liner 162 is shown in spaced relation to its corresponding adhesive 160 in FIG. 6D for clarity, but each release liner 162 will actually be positioned on its corresponding adhesive 160.

Consider the case where a single blister card 10 is disposed within the container 152' and as shown in FIGS. 6D-E. When the two release liners 162 are removed in the above-noted manner, the container 152' may be compressed to dispose each of the two sides of the blister card 10 (its upper surface 14 and lower surface 16) in interfacing relation with the adjacent inner wall of the panels 154, 156 (e.g., disposes the blister card 10 within the interior of a stack defined by the first panel 154, the blister card 10, and the second panel 156). Bonding the blister card 10 to the inner wall of each of the panels 154, 156 in this manner disposes the blister card 10 within the internal storage area 170 of the container 152', which should reduce the potential of pharmaceutical product 30 thereafter being removed from such a blister card 10 (e.g., such that no covering 20 for any receptacle 18 of the blister card 10 is accessible at this time).

If the container 152' is formed so as to not be easily ruptured, torn, or the like, two blister cards 10 could be contained within the container 152' when disposed in a configuration for disposal. Either side of a first blister card 10 could be bonded to the inside wall of the first panel 154 to become bonded within the interior of the container 152' and rendered at least substantially inaccessible (e.g., such that no covering 20 for any receptacle 18 of the blister card 10 is accessible at this time). Either side of second blister card 10 could be bonded to the inside wall of the second panel 156 to become bonded within the interior of the container 152' and rendered at least substantially inaccessible (e.g., such that no covering 20 for any receptacle 18 of the blister card 10 is accessible at this time).

Figure 7A:
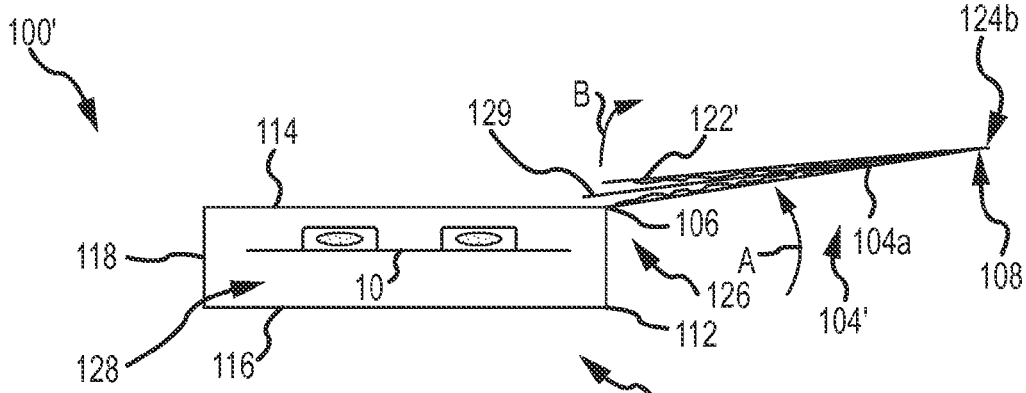
FIGS. 7A-C are sequential end views of a variation of the pharmaceutical product supply of FIGS. 4A-C.
Figure 7B:
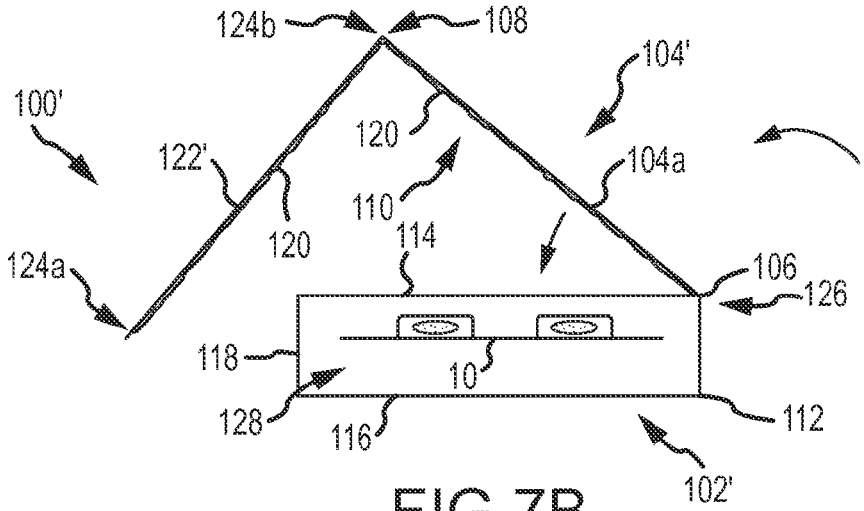
Figure 7C:
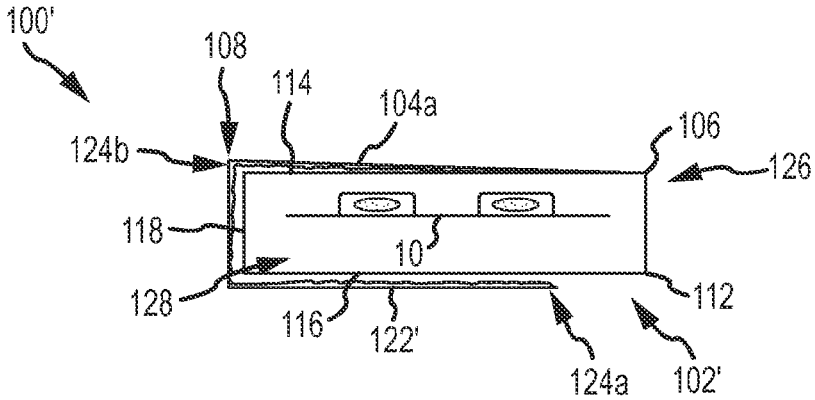

Another embodiment of a pharmaceutical product supply is illustrated in FIGS. 7A-C, is identified by reference numeral 100', and is a variation of the pharmaceutical product supply 100 of FIGS. 4A-C. Corresponding components between these two embodiments are identified by the same reference numeral. Those corresponding components that differ in at least some respect are identified by a "single prime" designation in FIGS. 7A-C.

The pharmaceutical product supply 100' includes a container 102' in the form of a three-paneled structure. The container 102' includes a first panel 104' and the above-discussed second panel 112. The first panel 104' in this embodiment is actually itself a two-paneled structure—including a first panel section 104*a* and a second panel section 122'. An intersection or fold line 126 may exist between the first panel 104' and the second panel 112.

The first panel section 104*a* includes a first surface 110. An adhesive 120 is included on all or part of this first surface 110. The first panel section 104*a* may be characterized as having a pair of oppositely disposed ends 106, 108. The end 106 is disposed at the intersection 126 with the second panel 112.

Instead of being in the form of a release liner 122 in the case of the embodiment of FIGS. 4A-C, reference numeral 122' in the embodiment of FIGS. 7A-C is actually in the form of a second panel section 122'. All or part of a surface of the second panel section 122' that may be disposed in overlying relation to the first panel section 104*a* includes adhesive 120. One or more removable release liners 129 may be disposed between the adhesive 120 on first panel section 104*a* and the second panel section 122'.

One end 124*b* of the second panel section 122' is attached to the first panel section 104*a* at or near its free end 108 (more generally, at a location spaced from where the first panel section 104*a* adjoins the second panel 112). The other end 124*a* of the second panel section 122' is "free" so that the second panel section 122' may be pulled away from the first surface 110 of the first panel section 104*a*. Prior to removing the release liner(s) 129, the first panel 104' (along with each release liner 129) may be pivoted in the direction indicated by the arrow A in FIG. 7A so as to be disposed in overlying relation to the second panel 112, to in turn dispose the container 102' in a configuration for storing one or more blister cards 10 between dosing events.

The second panel section 122' may be moved in the direction of the arrow B in FIG. 7A (e.g., pivoted about a fold line between the first panel section 104*a* and the second panel section 122') to expose the each release liner 129 (located between the first panel section 104*a* and the second panel section 122' when disposed in interfacing or overlying relation) in preparation for disposal of the associated blister card(s) 10 (e.g., to dispose the container 102' in a configuration for disposal with unused pharmaceutical product 30 remaining in one or more blister cards 10). This may be referred to as "opening" the first panel 104'. A patient or other user may grab the free end 124*a* of the second panel section 122' (FIG. 7A) and move the same entirely away from the first surface 110 of the first panel section 104*a* and at least generally in the direction of the arrow B in FIG. 7A. However, the second panel section 122' extends from and remains attached to the first panel section 104*a* (e.g. FIG. 7B). With the second panel section 122' being moved away from the first surface 110 of the first panel section 104*a*, the first panel section 104*a* may be pivoted in the direction indicated by the arrow A in FIG. 7A (also depicted by the arrow in FIG. 7B; e.g., about a fold line between the first panel section 104*a* and the second panel 112) so that its first surface 110 comes into contact with the front side 114 of the second panel 112 (the side of the second panel 112 that includes or provides access to at least one blister card 10 in the illustrated configuration). The second panel section 122' (again attached to or extending from first panel section 104*a* at a location spaced from its intersection 126 with the second panel 112) may be pulled around an end section 118 of the second panel 112 and may be disposed against and adhered to at least part of the back side 116 of the second panel 112. As the container 102' does not include any openable access after being disposed in this configuration (e.g., no openable cover/lid/flap; no perforations or scoring included by the container 102' for defining an openable cover/lid/flap; such that no covering 20 for any receptacle 18 of the blister card 10 is accessible at this time), the blister card 10 should be rendered at least substantially inaccessible at this time.

Bonding the first panel section 104*a* of the first panel 104' to the front side 114 of the second panel 112, bonding the second panel section 122' to the back side 116 of the second panel 112, or both, should reduce the potential of pharmaceutical product 30 thereafter being removed from any blister card 10 within or incorporated by the container 102' (e.g., such that no covering 20 for any receptacle 18 of the blister card 10 is accessible at this time). Bonding the first panel section 104*a* of the first panel 104' to the front side 114 of the second panel 112, bonding the second panel section 122' to the back side 116 of the second panel 112, or both, disposes one or more blister cards 10 within the interior of the container 102, which should reduce the potential of pharmaceutical product 30 thereafter being removed from any such blister card 10 (e.g., such that no covering 20 for any receptacle 18 of the blister card 10 is accessible at this time).

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A pharmaceutical product supply, comprising:

a first panel and a second panel, wherein said first panel comprises a first section and a second section, wherein said first section adjoins said second panel, and wherein said second section is folded onto said first section when said pharmaceutical product supply is in a first configuration;

a pharmaceutical product receiver associated with said second panel and comprising a plurality of receptacles;

pharmaceutical product enclosed within at least one of said plurality of receptacles of said pharmaceutical product receiver; and adhesive between said first section of said first panel and said second section of said first panel when said pharmaceutical product supply is in said first configuration;

wherein said first panel is movable between an open position and a closed position relative to said second panel to provide access to said pharmaceutical product receiver when said pharmaceutical product supply is in said first configuration, and wherein said second section of said first panel is disposed between said second panel and said first section of said first panel when said first panel is in said closed position and when said pharmaceutical product supply is in said first configuration; and wherein said pharmaceutical product supply is disposable and retained in a second configuration where said second section of said first panel is moved away from said first section of said first panel, where said first section of said first panel is adhered to at least a first side of said second panel, and where said second section of said first panel is adhered to at least a second side of said second panel, wherein said first side of said second panel and said second side of said second panel are oppositely disposed to one another.

2. The pharmaceutical product supply of claim 1, wherein said pharmaceutical product receiver is incorporated on said first side of said second panel, wherein said second section of said first panel comprises a release liner that is attached to said first section of said first panel at a location that is spaced from an intersection between said first panel and said second panel, and wherein a surface of said release liner and a surface of said first section of said first panel that face each other with said pharmaceutical product supply being in said first configuration each comprise said adhesive.

3. The pharmaceutical product supply of claim 1, wherein said second section of said first panel comprises a release liner that is attached to said first section of said first panel at a location that is spaced from an intersection between said first panel and said second panel, wherein a surface of said release liner and a surface of said first section of said first panel that face each other with said pharmaceutical product supply being in said first configuration each comprise said adhesive, and wherein said first side of said second panel comprises an opening to an internal storage area in which said pharmaceutical product receiver is disposed.

4. The pharmaceutical product supply of claim 3, further comprising a second pharmaceutical product receiver within said internal storage area.

5. The pharmaceutical product supply of claim 3, wherein a first end of said first section of said first panel is at said intersection between said first panel and said second panel, and wherein said release liner is attached to a second end of said first section of said first panel that is opposite of said first end.

6. The pharmaceutical product supply of claim 3, wherein at least one of said first section of said first panel and said release liner is also adhered to an end section of said second panel when said pharmaceutical product supply is in said second configuration.

7. The pharmaceutical product supply of claim 1, wherein said pharmaceutical product receiver is incorporated on said first side of said second panel, wherein said second section of said first panel is attached to said first section of said first panel at a location that is spaced from an intersection between said first panel section and said second panel, wherein a surface of said first section of said first panel and a surface of said second section of said first panel that face each other when said pharmaceutical product supply is in said first configuration each comprise said adhesive, said pharmaceutical product supply further comprising:

at least one release liner between said surface of said first section of said first panel and said second section of said first panel that face each other when said pharmaceutical product supply is in said first configuration.

8. The pharmaceutical product supply of claim 1, wherein said pharmaceutical product receiver is incorporated on said first side of said second panel, wherein said first side of said second panel comprises an opening to an internal storage area in which said pharmaceutical product receiver is disposed, wherein said second section of said first panel is attached to said first section of said first panel at a location that is spaced from an intersection between said first section of said first panel and said second panel, wherein a surface of said first section and a surface of said second section of said first panel that face each other when said pharmaceutical product supply is in said first configuration each comprise said adhesive, said pharmaceutical product supply further comprising:

at least one release liner between said surface of said first section of said first panel and said second section of said first panel that face each other when said pharmaceutical product supply is in said first configuration.

9. The pharmaceutical product supply of claim 8, further comprising a second pharmaceutical product receiver within said internal storage area.

10. The pharmaceutical product supply of claim 8, wherein a first end of said first section of said first panel is at said intersection between said first panel and said second panel, and wherein said second section of said first panel is attached to a second end of said first section of said first panel that is opposite of said first end.

11. The pharmaceutical product supply of claim 8, wherein at least one of said first section of said first panel and said second section of said first panel is also adhered to an end section of said second panel when said pharmaceutical product supply is in said second configuration.

12. The pharmaceutical product supply of claim 1, wherein each said receptacle comprises an opening, each receptacle of said plurality of receptacles that includes said pharmaceutical product having a corresponding covering over its corresponding said opening, and wherein no said corresponding covering for any of said plurality of receptacles is accessible through any operable access on said first panel when said pharmaceutical product supply is disposed and retained in said second configuration.

13. A pharmaceutical product supply, comprising:

first panel and a second panel, wherein said first panel comprises a surface having an adhesive, wherein a release liner is attached to said first panel at a location that is spaced from an intersection between said first panel and said second panel, and wherein said release liner comprises a surface having an adhesive;

a pharmaceutical product receiver associated with said second panel and comprising a plurality of receptacles; and pharmaceutical product enclosed within at least one of said plurality of receptacles of said pharmaceutical product receiver;

wherein said first panel is movable between an open position and a closed position relative to said second panel to provide access to said pharmaceutical product receiver when said pharmaceutical product supply is in a first configuration where said surface of said release liner having said adhesive is positioned over said surface of said first panel having said adhesive; and wherein said pharmaceutical product supply is disposable and retained in a second configuration where said release liner is moved away from said first panel, where said first panel is adhered to at least a first side of said second panel, and where said release liner is adhered to at least a second side of said second panel, wherein said first side of said second panel and said second side of said second panel are oppositely disposed to one another.

14. The pharmaceutical product supply of claim 13, wherein said pharmaceutical product receiver is incorporated on said first side of said second panel.

15. The pharmaceutical product supply of claim 13, wherein said first side of said second panel comprises an opening to an internal storage area in which said pharmaceutical product receiver is disposed.

16. The pharmaceutical product supply of claim 15, further comprising a second pharmaceutical product receiver within said internal storage area.

17. The pharmaceutical product supply of claim 13, wherein a first end of said first panel is at said intersection between said first panel and said second panel, and wherein said release liner is attached to a second end of said first panel that is opposite of said first end.

18. The pharmaceutical product supply of claim 13, wherein at least one of said first panel and said release liner is also adhered to an end section of said second panel when said pharmaceutical product supply is in said second configuration.

19. The pharmaceutical product supply of claim 13, wherein each said receptacle comprises an opening, each receptacle of said plurality of receptacles that includes said pharmaceutical product having a corresponding covering over its corresponding said opening, wherein no said corresponding covering for any of said plurality of receptacles is accessible through any openable access on said first panel when said pharmaceutical product supply is disposed and retained in said second configuration.

* * * * *